United States Patent [19]

Bevilaqua et al.

[11] 4,365,691

[45] Dec. 28, 1982

[54] INTEGRATED ELEVATOR CAB FIXTURE

[75] Inventors: Ernest M. Bevilaqua, Wilton; Allan L. McCroskery, Weston, both of Conn.; Theodore N. Knerr, New York, N.Y.

[73] Assignee: Otis Elevator Company, Farmington, Conn.

[21] Appl. No.: 230,974

[22] Filed: Feb. 2, 1981

[51] Int. Cl.[3] ..... B66B 9/00

[52] U.S. Cl. ..... 187/1 R; 340/21; 248/DIG. 4

[58] Field of Search ..... 187/1 R, 29 R, 28; 340/19 R, 21, 372, 366 R; 248/542, DIG. 4; 312/234; 182/18

[56] References Cited

U.S. PATENT DOCUMENTS 2,738,489 3/1956 Bordan ..... 340/21
4,008,935 2/1977 Zeloyle ..... 312/234

FOREIGN PATENT DOCUMENTS 2220435 4/1972 Fed. Rep. of Germany ..... 187/1 R

*Primary Examiner*—Joseph J. Rolla
*Assistant Examiner*—Kenneth Noland
*Attorney, Agent, or Firm*—Robert E. Greenstien

[57] ABSTRACT

A control panel is attached to one wall of an elevator cab and selected elevator control buttons are located on a panel surface which is oriented upward and a cab display is located on a higher surface which is oriented downward, to permit passengers to easily reach the buttons and observe the display.

3 Claims, 5 Drawing Figures

INTEGRATED ELEVATOR CAB FIXTURE

DESCRIPTION

1. Technical Field

This invention relates to elevator systems and, in particular, elevator cab fixtures—control buttons, panels and displays—and their location in an elevator cab.

2. Background Art

As is well known, typical or conventional elevator cab fixtures comprise a control panel, basically a planar arrangement of control buttons fixed to one wall of the elevator cab, and a display of some type, usually located on one of the cab walls where most passengers can see it, and often above or at the top of the panel, but sometimes above the cab door, to show cab position and possibly direction—up/down. The main criteria controlling fixture location in the cab are ease of operation of the control panel buttons and convenient display visibility. In particular, the control buttons should be accessible to the passenger—and the display should be high enough so that it is not obstructed by other passengers, yet is easily seen by all passengers.

This typical arrangement, however, is usually located for average passengers, normal standing people of average height, and this often makes the fixtures extremely inaccessible for some passengers, such as children and handicapped persons, especially those in wheelchairs, who have limited reaching capability and whose view is easily obscured by other passengers in the cab. Being that the typical fixture arrangement and location in the cab is inconvenient for certain types of passengers who can be expected to use the elevator, greater emphasis is now being placed on making the fixtures convenient for them as well. But whatever the solution, it should not favor one type of passenger, and the fixtures should be equally convenient for children, occupants of wheelchairs, and normal standing occupants of average height and reach.

In an effort to standardize requirements somewhat to alleviate these problems, some "suggested minimum passenger elevator requirements for handicapped" passengers have been proposed, as published by the National Elevator Industry Association. Proposed as basic fixture dimensions for most situations, the bottom row of control buttons on the control panel should be no more than 35" above the floor height, and the top row of keys no higher than 54" above the floor. The bottom dimension is satisfactory for handicapped persons, namely those in wheelchairs, but are actually too low for the normal standing passenger, making the lower buttons difficult to see and reach, especially in a crowded car. Standards for the displays have not been proposed, but, naturally, should also be addressed in solving the problem.

DISCLOSURE OF INVENTION

An object of the present invention is to provide cab fixtures—control panels and displays—which are easily use by both handicapped and normal standing passengers.

According to a first aspect of the invention, primary control buttons for selecting floors and controlling door operation are located above the cab floor at a position where they can be conveniently reached by passengers below a set normal standing height range. Certain rows of buttons at this lower position are oriented upwards, at a strategic angle of orientation keyed to their distance above the floor, to enable normal standing passengers to see and reach them.

According to another aspect of the invention , a display is located at a distance above the floor level and above the buttons where it can be observed easily by normal standing passengers, but to enable passengers of less than average height to see it, namely those in wheelchairs, the display is oriented downward, at an angle keyed to the position of the display above the cab floor and a predicted height for these passengers.

The present invention consequently provides a composite—integrated—fixture characterized in that the control buttons can be observed and operated by a wide variety of passengers, without favoring any particular one of them, and the car position and motion display can be observed easily by all passengers.

Other objects and features of the present invention will be apparent from the remaining description of an embodiment of the invention.

BEST MODE FOR CARRYING OUT THE INVENTION

Figure 1:
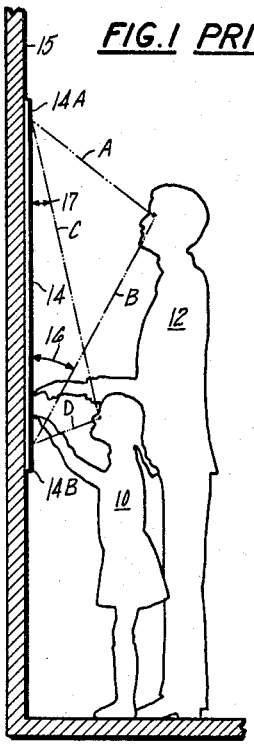
FIG. 1 PRIOR ART
FIG. 1 is a partial cutaway view of the side of an elevator cab containing a conventional control panel, and shows the viewing angles associated with a representative adult and a child passenger in the cab.

FIG. 1 shows a child 10 and an adult 12 standing in an elevator cab (partially shown only) and observing a conventional, generally flat control panel 14 attached to the cab wall 15. The panel contains along its length a plurality of stacked buttons, and at the panel top 14A, an indicator. Being well known, however, the buttons and display are not shown. Dotted lines A, B, C and D define each passenger's viewing path of the two extreme ends 14A and 14B of the control panel 14. The panel is assumed to be positioned lower than other panels positioned only for adults—as in most installations—to be convenient (easy to see and reach) for the child and also the adult. As a result, the viewing distance along paths A and B are not equal, producing a shallow viewing angle 16 at the lower end 14B, and making it difficult for the adult to see and reach the lower end. For the child 10, the reverse occurs, and the arrangement produces a shallow viewing angle 17 of the end 14A, but a deep viewing angle of the lower end 14B, hence, making the bottom accessible and the top hard to see.

Figure 2:
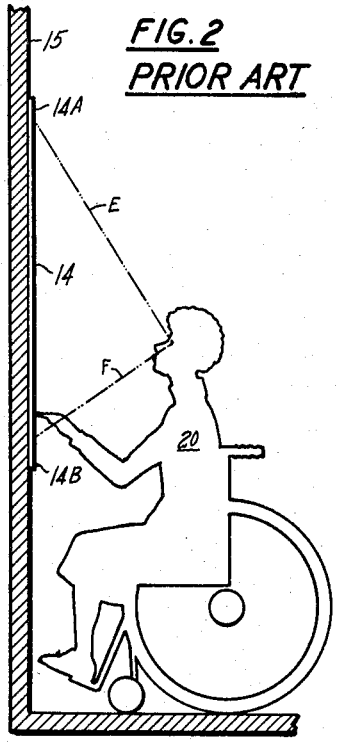
FIG. 2 PRIOR ART
FIG. 2 is the same view as in FIG. 1, but shows the viewing for a representative passenger in a wheelchair.

FIG. 2 shows the viewing paths E and F for a passenger 20 sitting in a wheelchair, and the same problem occurs for this passenger as for the child: it is hard to see the upper end, but easy to see and reach the lower end. FIGS. 1 and 2 demonstrate why merely lowering existing panels is not a satisfactory solution; it creates as many problems as it solves, and merely penalizes all passengers to some extent.

Figure 3:
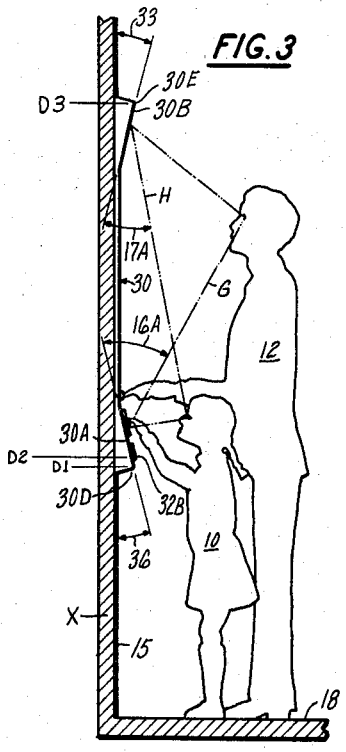
FIG. 3 is a partial cutaway view of the side of an elevator cab having a cab fixture embracing the present invention and shows the viewing angles for the representative adult and child passengers.
Figure 4:
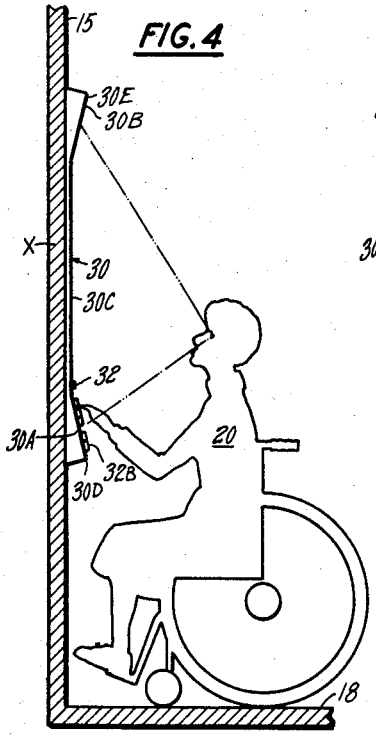
FIG. 4 is the same side view as FIG. 3, but shows the viewing angles for the passenger in a wheelchair.
Figure 5:
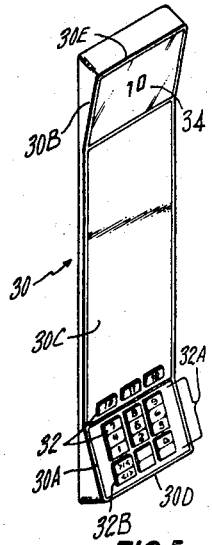
FIG. 5 is a perspective view of a control panel embracing the present invention.

FIGS. 3 and 4, on the other hand, show an integrated cab fixture 30, a combined control panel and display, according to one embodiment of the present invention. Shown in perspective in FIG. 5, the fixture 30 has a lower control button surface 30A, containing buttons 32, preferably arranged in rows, and an upper surface 30B, containing a display 34, for example, a digital display, for indicating car location and possibly car direction, or, for that matter, other information. In order to facilitate observation of the indicator, the surface 30B is at an angle 33 with respect to the vertical cab wall 15, and to facilitate observation and access to the control buttons the lower surface 30A is at an angle 36 with respect to the wall 15; the wall, of course, being vertical with the cab floor 18. The lower surface 30A may contain primary elevator control buttons 32A, those most often and likely to be used and relating door operation and car emergencies. Buttons of lesser importance, less likely to be used, may be located on a central flat portion 30C of the control panel, this portion 30C being parallel to the wall X, that is not at an angle with respect to it, thus substantially perpendicular to the cab floor.

FIG. 3, like FIG. 1, shows the two occupants 10 and 12, and FIG. 4, like FIG. 2, shows the occupant 20. But, contrasting FIGS. 1 and 3, by angling the surface 30A upward, the viewing angle 16A of the lower portion of the fixture (as seen on path G) is significantly more than the angle 16, making it easier for the passenger 12 to see and reach the lower buttons, without negatively affecting the viewing angle and access for passenger 10. The viewing angle 17A, of the upper portion 30B (as seen along path H), is significantly greater than the viewing angle 17 shown in FIG. 1, making it easier for the passengers 10, and also the passenger 20, to observe the display. The display is also easier for the passenger 12 to see because of the angle 33.

Assuming the suggested requirement, that the lowest buttons be no less than 35" above the floor height, these dimensions have been determined experimentally to be suitable for providing convenient operation for most passengers 10, 12 and 20 expected to use the cab: The lower edge 30D of the panel 30, at position D1, should be approximately 34" above the floor; the first row 32B of buttons, at position D2, approximately 35" to 36" above the floor; and the angle 36 about 14° to 15°. The overall panel length for these conditions should be such that the upper end of the panel 30E, at position D3, is 84" above the floor, and the angle 33 should be approximately 14° to 15°, like angle 36. The width of the panel should be such that the primary buttons can fit on the lower panel surface 30A. But, as stated previously, buttons may be placed in the center portion 30C.

A preferred embodiment of the present invention has been shown, but modifications, variations or alterations therein and thereto may be apparent or suggested to one skilled in the art without departing from the true scope and spirit of the invention embodied therein and claimed hereinafter.

We claim:

1. An elevator cab for transporting passengers including a control panel attached to one cab wall, a first surface containing a plurality of control buttons, the first surface being oriented upward at a first angle from a cab wall from a first distance from the cab floor, a second surface containing an information display device, the second surface being vertically above the first surface and oriented downward, at a second angle from the cab wall, from a second distance above the floor, the first distance being selected such that the majority of buttons on the first surface are substantially at eye level for a first group of passengers standing within reaching distance of the panel, the first angle being such that the viewing angle relative the first surface is oriented towards a second group of passengers standing within reaching distance of the panel, the second distance being such that the display is above the eye level of both said first and second groups, and the second angle being such that the viewing angle of the display is oriented downward towards both groups and first and second of passengers.

2. An elevator cab for transporting passengers including a control panel attached to one cab wall, a first surface containing a plurality of control buttons, the first surface being oriented upward at a first angle from a cab wall from a first distance from the cab floor, a second surface containing an information display device, the second surface being vertically above the first surface and oriented downward, at a second angle from the cab wall, from a second distance above the floor, the first distance being selected such that the majority of buttons on the first surface are substantially at eye level for a first group of passengers standing within reaching distance of the panel, the first angle being such that the viewing angle relative the first surface is oriented towards a second group of passengers standing within reaching distance of the panel, the second distance being such that the display is above the eye level of both said first and second groups, the second angle being such that the viewing angle of the display is oriented downward towards both groups said first and second of passengers, the first distance being approximately 34 inches, the first and second angles being approximately 14°, the second distance being approximately 82 inches.

3. The cab described in claim 2, characterized in that rows of control buttons extend horizontally across the first surface, relative to the cab floor, the lowest being approximately 36 inches above the cab floor.

* * * * *

UNITED STATES PATENT AND TRADEMARK OFFICE

CERTIFICATE OF CORRECTION

PATENT NO. : 4,365,691

DATED : December 28, 1982

INVENTOR(S) : Ernest M. Bevilacqua, et al

It is certified that error appears in the above-identified patent and that said Letters Patent is hereby corrected as shown below:

ON THE TITLE PAGE

Under "UNITED STATES PATENT [19]", "Bevilaqua et al." should read --Bevilacqua et al--.

After "[75] Inventors:", "Ernest M. Bevilaqua" should read --Ernest M. Bevilacqua--.

IN THE CLAIMS

Column 4, line 26, "groups and first and second" should read --said first and second groups--.

Column 4, line 51, "groups said first and second" should read --said first and second groups--.

Signed and Sealed this

*Twenty-second* Day of *March 1983*

[SEAL]

*Attest:*

GERALD J. MOSSINGHOFF

*Attesting Officer*

*Commissioner of Patents and Trademarks*